US005336820A

United States Patent [19]

Owen et al.

[11] Patent Number: 5,336,820

[45] Date of Patent: Aug. 9, 1994

[54] PROCESS FOR THE ALKYLATION OF BENZENE-RICH GASOLINE

[75] Inventors: Hartley Owen, Worton, Md.; Mohsen N. Harandi, Langhorne, Pa.

[73] Assignee: Mobil Oil Corporation, Fairfax, Va.

[21] Appl. No.: 104,689

[22] Filed: Aug. 11, 1993

[51] Int. Cl.[5] ..... C07C 2/66

[52] U.S. Cl. ..... 585/323; 585/313; 585/449; 585/467

[58] Field of Search ..... 585/323, 313, 449, 467

[56] References Cited

U.S. PATENT DOCUMENTS

| | | | |
|---|---|---|---|
| 2,305,026 | 12/1942 | Munday | 585/323 |
| 2,396,682 | 3/1946 | Carmody | 585/323 |
| 2,995,611 | 8/1961 | Linn | 585/323 |
| 3,770,614 | 11/1973 | Graven | 208/62 |
| 4,975,179 | 12/1990 | Harandi et al. | 208/66 |
| 4,992,607 | 2/1991 | Harendi et al. | 585/323 |
| 5,073,653 | 12/1991 | Butler | 585/323 |
| 5,120,890 | 6/1992 | Sachtler et al. | 585/323 |

*Primary Examiner*—Asok Pal

*Attorney, Agent, or Firm*—A. J. McKillop; M. D. Keen

[57] ABSTRACT

A process is disclosed for enhancing the alkylation conversion rate of a benzene-rich gasoline boiling range hydrocarbon feedstream alkylated with $C_2$–$C_5$ olefins. The process comprises contacting the benzene-rich stream and olefins sequentially in decreasing order of olefin oligomerization activity comprising a first contact with $C_3$–$C_5$ olefins followed by contact with $C_2$ olefin, preferably at different points of an alkylation zone containing solid, shape selective aluminosilicate catalyst particles under benzene alkylation conditions. Gasoline is produced having a reduced benzene content.

22 Claims, 4 Drawing Sheets

PROCESS FOR THE ALKYLATION OF BENZENE-RICH GASOLINE

This invention relates to a process for the production of a more environmentally suitable gasoline by removing a substantial portion of benzene in gasoline by alkylation. More particularly, the invention relates to a method to improve the conversion rate of benzene alkylation in gasoline feedstreams by carrying out the alkylation process using a light olefin feed as alkylating agent in which the olefins are introduced sequentially in decreasing order of olefin oligomerization reactivity.

BACKGROUND OF THE INVENTION

Gasolines manufactured to contain a higher concentration of aromatics such as benzene, toluene and xylenes (BTX) can adequately meet the octane requirements of the marketplace for a high octane fuel. Aromatics, particularly benzene, are commonly produced in refinery processes such as catalytic reforming which have been a part of the conventional refinery complex for many years. However, their substitution for the environmentally unsuitable lead-based octane enhancers is complicated by environmental problems of benzene. Environmental and health related studies have raised serious questions regarding the human health effects of benzene. The findings suggest that exposure to high levels of benzene should be avoided with the result that benzene concentration in gasoline to enhance octane number is limited and controlled to a relatively low value.

When hydrocarbons boiling in the gasoline boiling range are reformed in the presence of a hydrogenation-dehydrogenation catalyst, a number of reactions take place which include dehydrogenation of naphthenes to form aromatics, dehydrocyclization of paraffins to form aromatics, isomerization reactions and hydrocracking reactions. The composition of the reformer effluent or reformate is shifted toward higher octane value product. Catalytic reforming primarily increases the octane of motor gasoline by aromatics formation but without increasing the yield of gasoline.

Reformates can be prepared by conventional techniques by contacting any suitable material such as a naphtha charge material boiling in the range of $C_5$ or $C_6$ up to about 380° F. (193° C.) with hydrogen in contact with any conventional reforming catalyst. Typical reforming operating conditions include temperatures in the range of from about 800° F. (427° C.) to about 1000° F. (538° C.), preferably from about 890° (477° C.) up to about 980° F. (527° C.), liquid hourly space velocity in the range of from about 0.1 to about 10, preferably from about 0.5 to about 5; a pressure in the range of from about atmospheric up to about 700 psig (4900 kPa) and higher, preferably from about 100 (700 kPa) to about 600 psig (4200 Kpa); and a hydrogen-hydrocarbon ratio in the charge in the range from about 0.5 to about 20 and preferably from about 1 to about 10.

The treatment of a reformate with crystalline aluminosilcate zeolites is known in the art and has included both physical treatments such as selective adsorption, as well as chemical treatments such as selective conversion thereof. In U.S. Pat. No. 3,770,614 to Graven a process combination is described for upgrading naphtha boiling range hydrocarbons by a combination of catalytic reforming and selective conversion of paraffinic components to enhance yield of aromatic hydrocarbons by contact with crystalline aluminosilicate catalyst having particular conversion characteristics. In U.S. Pat. No. 3,649,520 to Graven a process is described for the production of lead free gasoline by an integrated process of reforming, aromatics recovery and isomerization including $C_6$ hydrocarbons upgrading to higher octane product for blending.

U. S. Pat. No. 3,767,568 to Chen, incorporated herein by reference, discloses a process for upgrading reformates and reformer effluents by contacting them with specific zeolite catalysts so as to sorb methyl paraffins at conversion conditions and alkylate a portion of aromatic rings contained in the reformates.

Recently, a process has been developed to overcome some of the foregoing challenges in the reformulation of gasoline. The process is known in the art as the Mobil Benzene Reduction (MBR) process and is closely related to the Mobil Olefins to Gasoline (MOG) process. The MBR and MOG processes are described in U.S. Pat. No. 4,827,069 to Kushnerick, U.S. Pat. No. 4,950,387 and U.S. Pat. No. 4,992,607 to Harandi, and U.S. Pat. No. 4,746,762 to Avidan, all of common assignee. These patents are incorporated herein by reference.

The MBR process is a fluid bed process which uses shape selective, metallosilicate catalyst particles, preferably ZSM-5, to convert benzene to alkylaromatics using olefins from sources such as FCC or coker fuel gas, excess LPG, light FCC naphtha or the like. Benzene is converted, and light olefin is also upgraded to gasoline concurrent with an increase in octane value. Conversion of light FCC naphtha olefins also leads to substantial reduction of gasoline olefin content and vapor pressure. The yield-octane uplift of MBR makes it one of the few gasoline reformulation processes that is actually economically beneficial in petroleum refining.

The MBR process as practiced has relied upon light olefin as alkylating agent for benzene to produce alkylaromatic, principally in the $C_7$–$C_9$ range. The light olefins generally preferred include $C_2$–$C_7$ olefins. However, under MBR alkylation conditions the conversion rate for the alkylation of benzene is lower than would be expected. The reason for this lower conversion rate is the reactivity of light olefins to form oligomers. The oligomerization reactions occurs at a rate competitive with alkylation and so diminishes the alkylation conversion rate.

It is an object of the present invention to provide a process to lower the benzene content of gasoline while enhancing octane value by alkylation of benzene using a method that substantially increases the rate of conversion of benzene to alkyl aromatics.

A further object of the invention is to provide the foregoing improved gasoline having a lower Reid vapor pressure, a lower olefin content and a lower sulfur content.

SUMMARY OF THE INVENTION

A discovery has been observed which reveals that in the process for the alkylation of benzene in a gasoline feedstream with light olefins in contact with metallosilicate catalyst particles ethylene is the most selective light olefin for production of alkylaromatics. The selectivity of higher olefins is lower due to their propensity to react with themselves, i.e., oligomerize. These reactions take place at substantially different rates depending on the olefins present in the mixture. Accordingly, a process has been discovered for enhancing the alkylation conversion rate for a benzene-rich gasoline boiling range hydrocarbon feedstream alkylated with a hydrocarbon stream comprising $C_2+$ olefins to produce product gasoline having a reduced benzene content. The process comprises contacting the benzene-rich stream and olefins sequentially in decreasing order of olefin oligomerization activity or reactivity with solid, shape selective aluminosilicate catalyst particles in a catalyst bed under benzene alkylation conditions. An effluent stream is produced comprising gasoline having a reduced benzene content representative of an enhanced conversion rate for benzene. The process of the invention also results in desulfurization of the feedstream and reduction in vapor pressure such that the Reid vapor pressure is lower and the product sulfur content is lower.

More particularly, a multi-stage process has Deen discovered for enhancing the alkylation conversion rate of a benzene-rich gasoline boiling range hydrocarbon feedstream alkylated with a hydrocarbon stream comprising $C_2+$ olefins to produce product gasoline having a reduced benzene content. The multi-stage process comprises contacting a benzene-rich feed stream in a first stage fluid bed alkylation zone with shape selective metallosilicate catalyst particles and the $C_3+$ portion of the olefins under benzene alkylation conditions. The effluent from the first stage alkylation zone is distilled to produce an overhead stream comprising $C_6-$ hydrocarbons containing unreacted benzene and a bottom stream comprising $C_7+$ hydrocarbons containing alkylated benzene. The overhead stream is contacted with the $C_2$ portion of the olefins in a second stage fluid bed alkylation zone with shape selective metallosilicate catalyst particles under benzene alkylation conditions whereby a second stage effluent stream is produced comprising alkylated benzene and unreacted $C_6-$ hydrocarbons. The second stage effluent stream is separated to recover product gasoline having a lower benzene content, lower Reid vapor pressure and lower sulfur content.

DETAIL DESCRIPTION OF THE INVENTION

Figure 1:
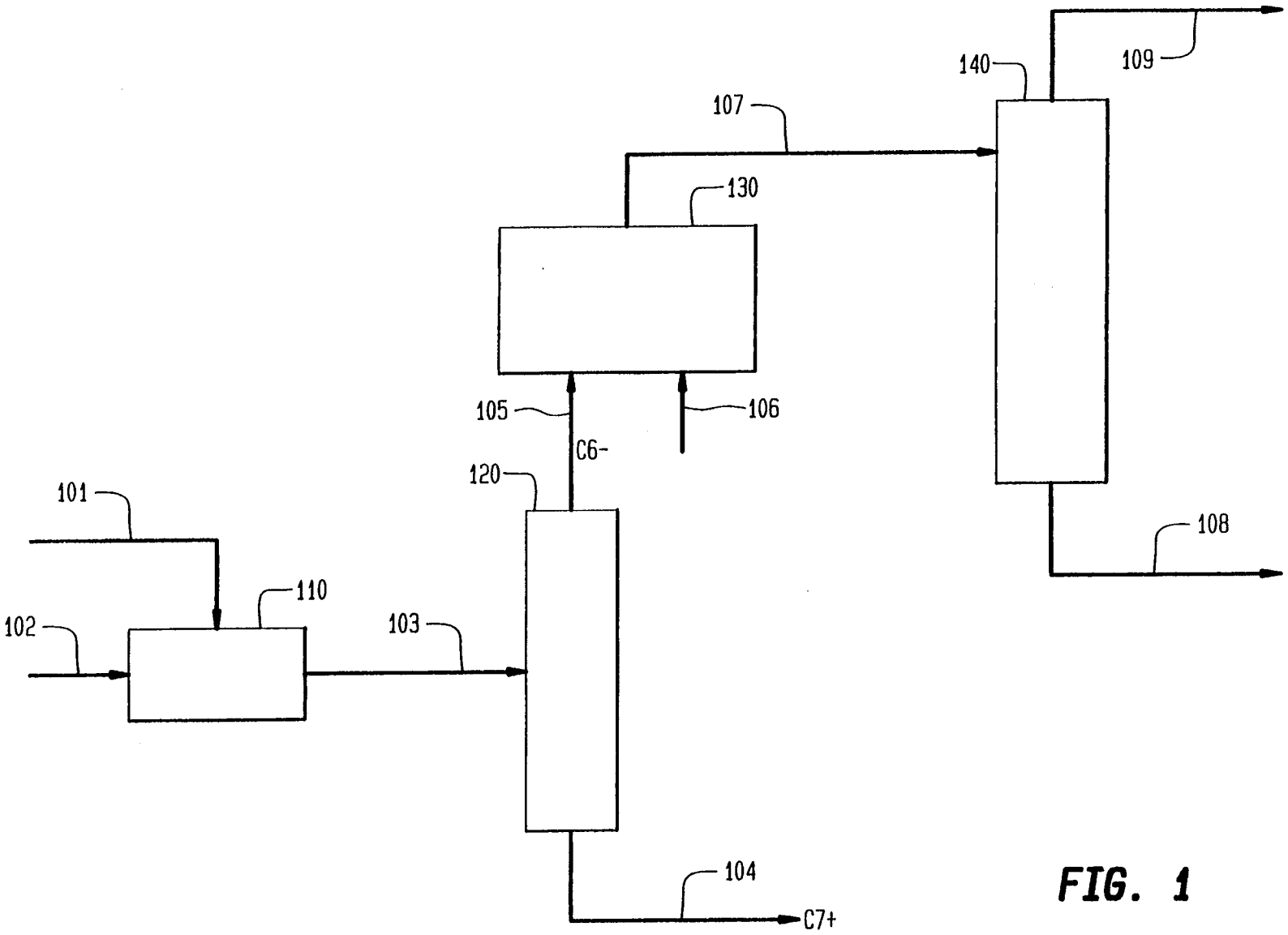
FIG. 1 is a process flow diagram depicting a preferred multistage embodiment of the present invention wherein benzene is alkylated sequentially with olefins in decreasing order of oligomerization reactivity with intermediate separation of alkylate.

The present invention comprises an improvement to the Mobil Benzene Reduction process (MBR) generally described herein before and in the cited U.S. patents incorporated by reference. The invention provides a process for lowering the benzene content, olefin content, Reid vapor pressure and sulfur content of any benzene rich $C_5+$ gasoline boiling range hydrocarbon feedstream while enhancing octane value. While these achievements are basic endowments of the MBR process when alkylation of benzene is carried out with light olefins, the present invention embodies the discovery that high alkylation conversion rates can be achieved when the light olefins alkylating agent feed to the MBR reactor is fed sequentially in decreasing order of the reactivity of the particular olefin toward oligomerization.

By feeding olefins to an MBR reactor in conjunction with a benzene-rich stream in decreasing order of olefin oligomerization reactivity the competing reactions of alkylation versus oligomerization are controlled to favor alkylation. Generally, light olefin oligomerization reactivity decreases in the order propylene>butene>pentene>ethylene. When the initial alkylation feedstream to an MBR reactor is $C_3+$ olefins, the relatively high concentration of benzene promotes benzene alkylation over $C_3+$ olefin oligomerization. Then, when benzene concentration is depleted and ethylene is fed to the reactor, benzene alkylation with ethylene is favored since ethylene oligomerization reactivity is comparatively low. By this means of sequential olefin feed to the MBR reactor according to oligomerization reactivity conversion of olefins to alkylate is favored as opposed to the formation of undesirable oligomer.

The invention is particularly useful when ethylene utilization is desired since it is both the least reactive olefin for oligomerization and, in a fuel gas feedstream, it is very dilute. It is preferred to introduce the dilution effect on benzene alkylation as late in the reaction as possible.

In a preferred embodiment the invention provides a process integrated into the reformer section of a refinery for the manufacture of high octane gasoline. The invention can improve the economics of meeting the benzene specification of the gasoline pool, preferably reducing the pool benzene content below 1% or 0.8%.

Any benzene rich $C_5+$ gasoline boiling range hydrocarbon feedstream can be used in the MBR process and in the improvement to the MBR process comprising this invention. Preferred feedstreams include FCC gasoline and reformate. However, reformate is most preferred feedstream. Conventionally, light olefins feedstreams are mixed into one feedstream and used as alkylating agent. Benzene alkylation processes to reduce gasoline benzene content use light olefinic gas feedstocks containing ethylene, propylene or butenes as the alkylating agent. Refinery olefinic streams typically include FCC offgas, fuel gas, and LPG. The reaction takes place over appropriate catalysts to produce alkyl aromatic hydrocarbons with improved gasoline octane and yield.

It has been observed that the utilization of specific light olefins in the alkylation of benzene differs considerably with ethylene being the most selective for the production of alkylaromatics in the MBR process. Heavier olefins such as propylene, butylene and amylene are less selective because they react with themselves at a higher rate than ethylene reacts with itself.

As a result, an environment is produced that is less conducive to alkylating benzene when a mixture of light olefins is used as alkylating agent. In such an environment, the MBR process as practiced heretofore generally experiences a rate for benzene conversion to alkylate of less than 40 weight percent and an appreciable amount of the $C_3$–$C_5$ olefins are converted to oligomers. The process of the present invention involving the sequential addition of light olefins according to their alkylation reactivity enjoys a rate for benzene conversion to alkylaromatics of above forty weight percent. Some embodiments of the invention can experience conversion rates greater than sixty weight percent.

Reformates or reformer effluents which are composed substantially of paraffinic and aromatic constituents can be prepared according to conventional techniques by contacting any suitable material such as naphtha charge material or heavy straight run gasoline boiling in the range of $C_5$ and preferably in the range of $C_6$ up to about 400° F. (204° C.) and higher with hydrogen at least initially in contact with any reforming catalyst. This is a conventional reforming operation which involves a net production of hydrogen and is well known to those skilled in the art as described in Chapter 6 of Petroleum Refining by James H. Gray and Glenn E. Handwerk as Published by Marcel Dekker, Inc. (1984).

Reforming catalysts in general contain platinum supported on an alumina or silica-aluminum base. Preferably, rhenium is combined with platinum to form a more stable catalyst which permits operation at lower pressures. It is considered that platinum serves as a catalytic site for hydrogenation and dehydrogenation reactions and chlorinated alumina provides an acid site for isomerization, cyclization, and hydrocracking reactions. Some impurities in the feed such as hydrogen sulfide, ammonia and organic nitrogen and sulfur compounds will deactivate the catalyst. Accordingly, feed pretreating in the form of hydrotreating is usually employed to remove these materials. Typically feedstock and reforming products or reformate have the following analysis:

TABLE 1

| COMPONENT (vol %) | FEED | PRODUCT |
|---|---|---|
| Paraffins | 45–55 | 30–50 |
| Olefins | 0–2 | 0 |
| Naphthenes | 30–40 | 0–10 |
| Aromatics | 5–10 | 45–60 |

Reforming operating conditions include temperatures in the range of from about 800° F. (427° C.) to about 1000° F. (538° C.), preferably from about 890° (477° C.) up to about 980° F. (527° C.), liquid hourly space velocity in the range of from about 0.1 to about 10, preferably from about 0.5 to about 5; a pressure in the range of from about atmospheric up to about 700 psig (4900 Kpa) and higher, preferably from about 100 (700 kPa) to about 600 psig (4200 Kpa); and a hydrogen-hydrocarbon ratio in the charge in the range from about 0.5 to about 20 and preferably from about 1 to about 10.

Conversion of a benzene rich gasoline feedstream used in the present invention in contact with metallosilicate catalyst particles is generally carried out at a temperature between 500° F. (260° C.) and about 1000° F. (538° C.) preferably between 550°–900° F. (288°–482° C.) and most preferably between 700°–850° F. (371°–454° C.). The pressure is generally between about 50 (350 Kpa) and 3000 psig (21000 kPa), preferably between 50–200 psig (350–1460 kPa). The weight hourly space velocity is between 0.1 and 250. A most preferable weight hourly space velocity based on total feed is between 0.5 and 3 WHSV. If hydrogen is charged, the molar ratio of hydrogen to hydrocarbon charged can be as high as 10 but it is preferably zero. Any type of catalytic reactor can be used in the process of the invention including fluid bed, fixed bed, riser reactor, moving bed, and the like. However, fluid bed catalytic reactor is preferred.

Developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such Al, Ga, or Fe, within the zeolytic framework. These medium pore zeolites are favored for acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The catalysts preferred for use in the conversion step of the present invention include the crystalline aluminosilicate zeolites having a silica to alumina ratio of at least 12, and constraint index of about 1 to 12. Representative of the ZSM-5 type zeolites are ZSM-5, ZSM-11, ZSM-12, ZSM-22, ZSM-23, ZSM-35, zeolite Beta, MCM-22, MCM-36, MCM-49 and ZSM-48. ZSM-5 is disclosed and claimed in U.S. Pat. No. 3,702,886 and U.S. Pat. No. Re. 29,948; ZSM-11 is disclosed and claimed in U.S. Pat. No. 3,709,979.

The larger pore zeolites which are useful as catalysts in the process of this invention, i.e., those zeolites having a Constraint Index of no greater than about 2, are well known to the art. Representative of these zeolites are zeolite Beta, TEA mordenite and ZSM-12.

Zeolite Beta is described in U.S. Pat. No. Re. 28,341 (of original U.S. Pat. No. 3,308,069), to which reference is made for details of this catalyst.

Zeolite ZSM-12 is described in U.S. Pat. No. 3,832,449, to which reference is made for the details of this catalyst.

The method by which Constraint Index is determined is described fully in U.S. Pat. No. 4,016,218, to which reference is made for details of the method.

The preferred catalyst for use in the present invention is acidic ZSM-5 having an equilibrium alpha value less than 100, preferably less than 50. Alpha value, or alpha number, is a measure of zeolite acidic functionality and is more fully described together with details of its measurement in U.S. Pat. No. 4,016,218, *J. Catalysis*, 6, pp. 278–287 (1966) and *J. Catalysis*, 61, pp. 390–396 (1980).

Referring now to FIG. 1, a process flow diagram is presented which depicts a preferred multistage embodiment of the present invention wherein benzene is alkylated sequentially with olefins in decreasing order of olefin oligomerization reactivity with intermediate separation of alkylate. A benzene-rich feedstream such as reformate is passed 101 to a first stage MBR fluid bed reactor 110 containing acidic ZSM-5 catalyst particles. An olefins feedstream 102 comprising $C_3$ and/or heavier olefins such as propylene, 1-butene, 2-butene, isobutene and isomers of amylene or heavier olefins is also introduced into reactor 110. Alkylation of benzene is carried out under MBR alkylation conditions as described herein before to produce an effluent stream 103 containing $C_7+$ alkylaromatics, unconverted benzene, unconverted $C_3$ and/or heavier olefins plus gasoline boiling range and higher hydrocarbons. Benzene conversion in the first stage is less than about 40 weight percent. The first stage effluent 103 is passed to a distillation column 120 and a bottom stream 104 separated comprising $C_7$ + hydrocarbons including alkylaromatics. An overhead stream 105 is also removed from separator 120. The overhead stream comprises $C_6-$ hydrocarbons, including unconverted benzene and unconverted olefins from the first stage reactor. The stream 105 is introduced into a second stage MBR fluid bed reactor containing ZSM-5 catalyst particles together with an olefins feedstream 106 rich in ethylene such as fluid catalytic cracking (FCC) fuel gas. Alkylation is carried out in reactor 130 under MBR alkylation conditions described herein before. However, benzene conversion in the second stage reactor 130 is at least between 40–60 weight percent. An effluent stream 107 is withdrawn which contains $C_7+$ alkylaromatics, unconverted benzene, unconverted $C_3$ and/or heavier olefins plus gasoline boiling range and higher hydrocarbons. Stream 107 is separated in distillation column 140 to produce a bottom stream comprising $C_5+$ hydrocarbons including alkylaromatics and unconverted benzene. An overhead stream 109 is also separated from separator 130. The overhead stream comprises $C_4-$ hydrocarbons, including unconverted olefins.

Figure 2:
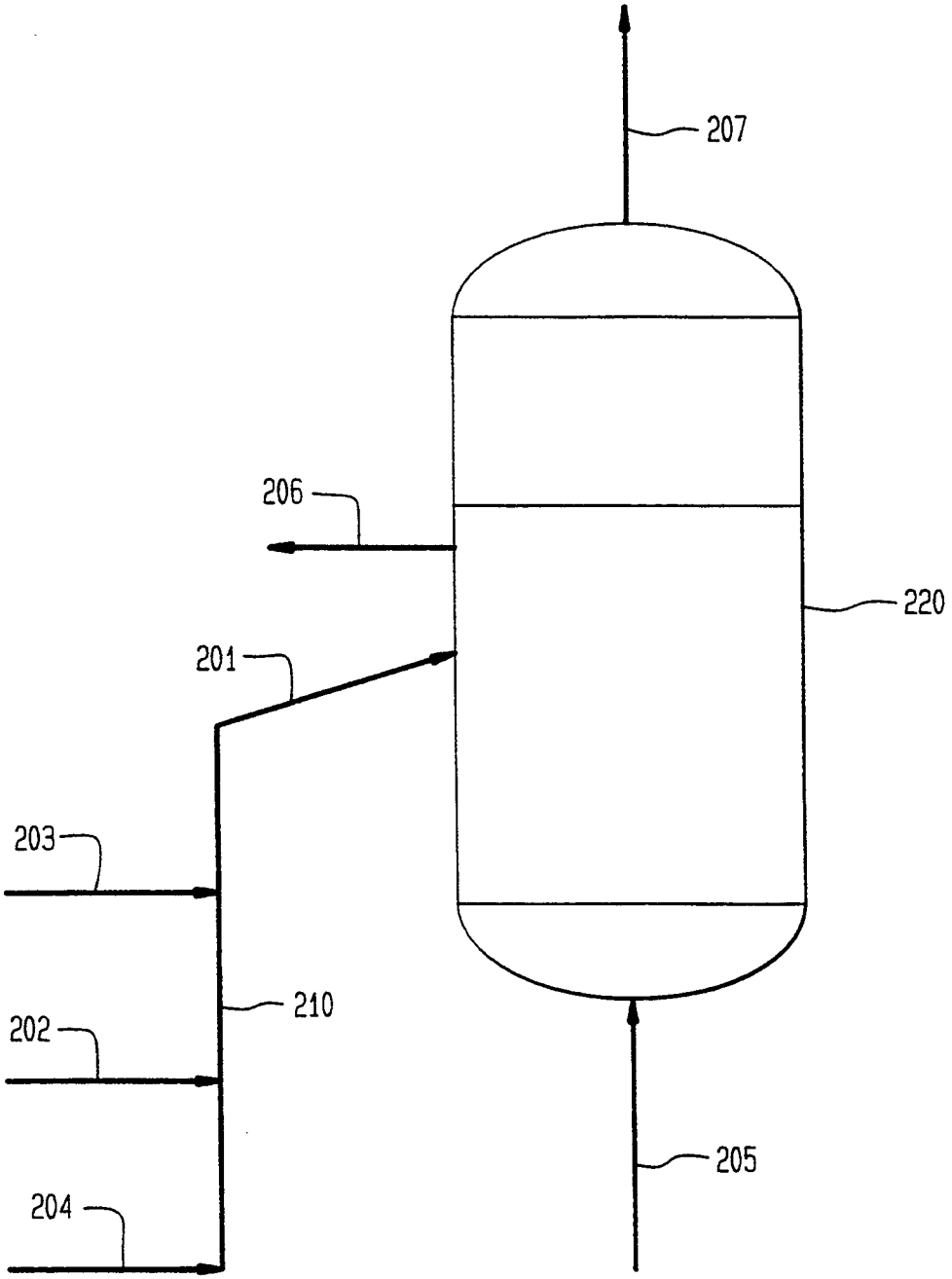
FIG. 2 is a process flow diagram depicting another preferred multistage embodiment of the present invention wherein benzene is alkylated sequentially with olefins in decreasing order of oligomerization reactivity in a first riser reactor with effluent fed to a fluid bed reactor.

Referring to FIG. 2, a process flow diagram depicting another preferred multistage embodiment of the present invention is presented. Benzene is alkylated sequentially with olefins in decreasing order of oligomerization reactivity in a first riser reactor 210 with effluent 201 fed to a second fluid bed reactor 220. A portion of the second stage catalyst from reactor 220 can be circulated through the riser reactor and a common catalyst regenerator can be used for catalyst regeneration. Catalyst flow is preferably from the first stage to the second stage and then to the regenerator with catalyst make-up added to the regenerator. In FIG. 2, a benzene-rich feedstream such as reformate is passed 202 to a first stage rise reactor 210 containing acidic ZSM-5 catalyst particles in conjunction with a recycle stream 203 of regenerated catalyst particles. An olefins feedstream 204 comprising $C_3$ and/or heavier olefins such as propylene, 1-butene, 2-butene, isobutene and isomers of amylene is also introduced into the riser reactor 210. Alkylation of benzene is carried out under MBR alkylation conditions as described herein before to produce an effluent stream 201 containing $C_7+$ alkylaromatics, unconverted benzene, unconverted olefins plus gasoline boiling range and higher hydrocarbons. The effluent stream 201 is passed directly and preferably to the lower portion of the fluid bed reactor 220 containing acidic ZSM-5 catalyst. An olefins feedstream 205 rich in ethylene such as fluid catalytic cracking (FCC) fuel gas is introduced into a bottom portion of reactor 220 and alkylation carried out in contact with ZSM-5 catalyst particles under MBR alkylation conditions. Deactivated or spent catalyst is withdrawn 206 for regeneration and/or recycle to the riser reactor. An effluent stream 207 from reactor 220 is withdrawn which contains $C_7+$ alkylaromatics, unconverted benzene, unconverted olefins plus gasoline boiling range and higher boiling hydrocarbons. Benzene conversion in the process of FIG. 2 is at least about 40 weight percent but preferably greater than 60 weight percent.

Figure 3:
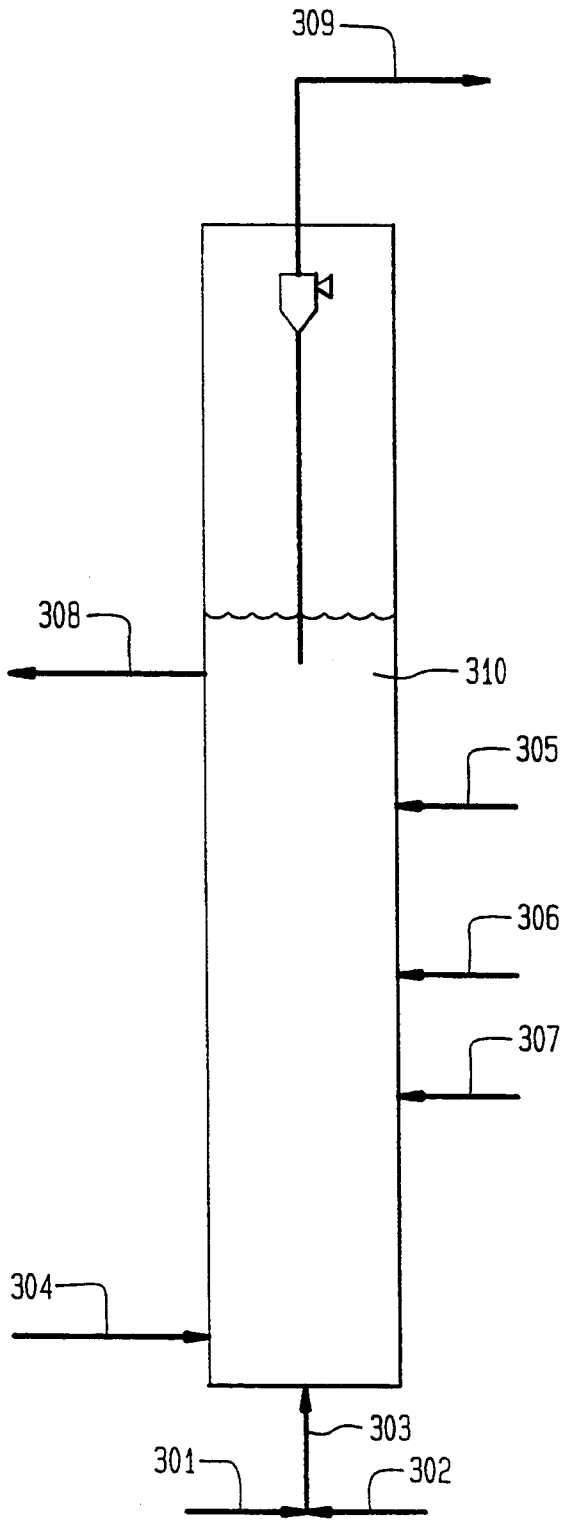
FIG. 3 is a process flow diagram depicting yet another preferred embodiment of the present invention wherein benzene is alkylated sequentially with olefins in decreasing order of olefin oligomerization reactivity in a single fluid bed tall reactor wherein oligomerization reactive olefins are introduced near the bottom of the reactor with benzene and regenerated catalyst while olefins less reactive in oligomerization reactions are fed into the vessel at a midportion.

Referring now to FIG. 3, a process flow diagram is depicted for yet another preferred embodiment of the present invention wherein benzene is alkylated sequentially with olefins in decreasing order of olefin oligomerization reactivity in a single fluid bed tall reactor 310 wherein less reactive olefins 301 are introduced 303 near the bottom of the reactor with a benzene-rich feedstream 302 plus regenerated catalyst 304. More reactive olefins, particularly ethylene-rich feeds, are fed into the vessel at a midportion 305, while steams 306 and 307 which are progressively less rich in ethylene but increasingly richer in heavier olefins than propene are introduced lower in the reactor vessel. Spent catalyst is withdrawn 308 for regeneration and recycle, The reactor effluent stream 309 from reactor 310 is withdrawn and contains $C_7+$ alkylaromatics, unconverted benzene, unconverted $C_3$ and/or heavier olefins plus gasoline boiling range and higher hydrocarbons. Benzene conversion in the process of FIG. 3 is also at least about 40 weight percent but preferably greater than 60 weight percent.

While the invention as described herein has been limited to fluid bed reactors, there is no intention to limit the use of the invention to fluid bed systems. The same concept and invention are applicable to fixed bed reactors which preferably use hydrogen circulation.

Figure 4:
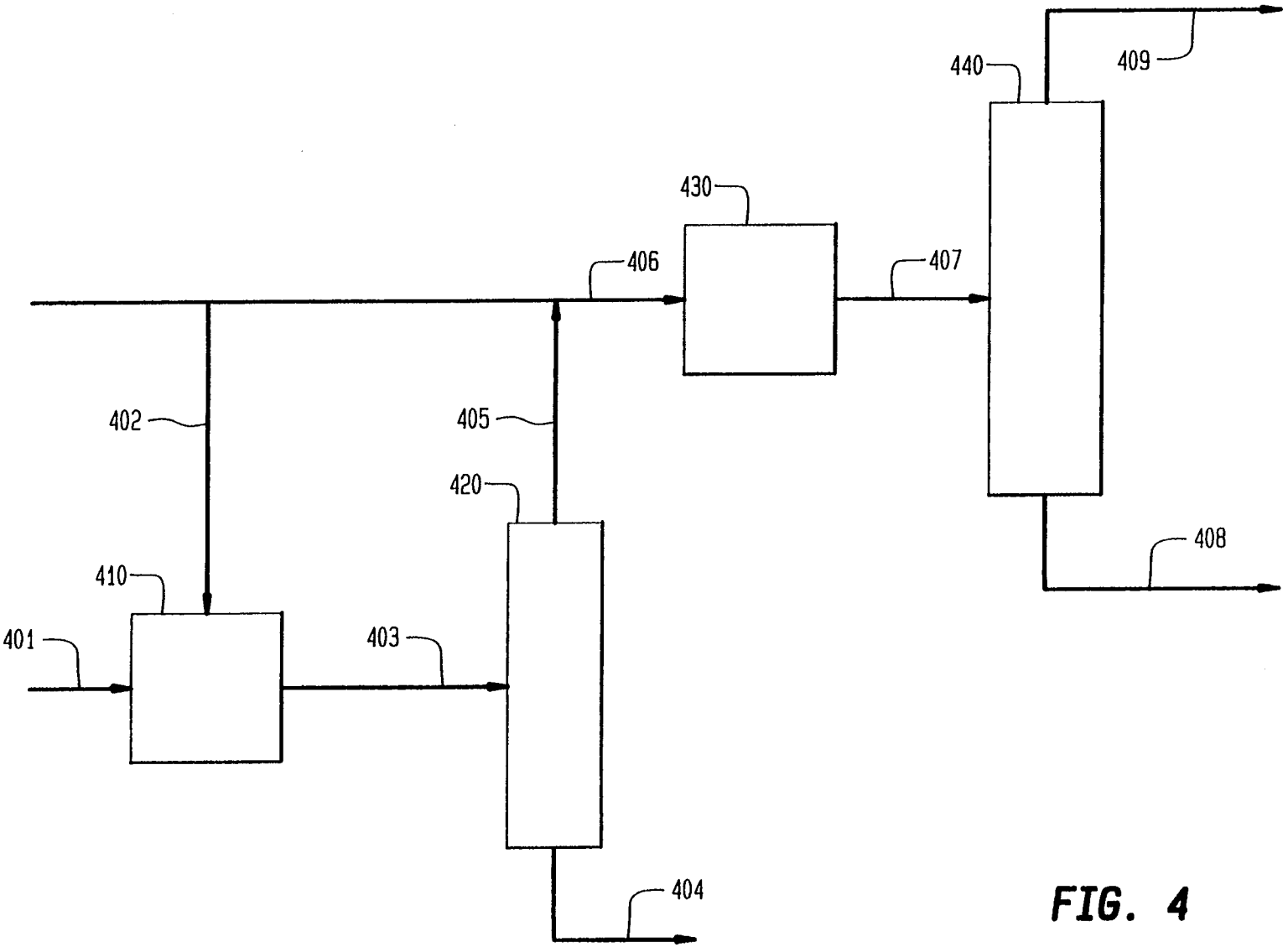
FIG. 4 is a process flow diagram of an embodiment of the invention wherein benzene is initially alkylated in an MBR reactor followed by separation of the $C_7+$ alkylate before passing the unalkylated portion to a second MBR alkylation zone in conjunction with additional. olefin feed.

A further improvement of the MBR process is depicted in FIG. 4 wherein $C_7+$ alkylaromatic are separated from the effluent from a first stage MBR reactor before completing the alkylation of the effluent in a second MBR reactor. $C_7+$ alkylaromatic are more reactive in alkylation than benzene. Therefore, their removal from the MBR effluent avoids the competive reaction between $C_7+$ alkylaromatic and benzene that would normally occur in the second stage MBR reactor if these alkylaromatics remained in the effluent. The result of their removal is an enhanced overall convesion of benzene to aklylaromatic.

Referring to FIG. 4, a benzene rich feedstream 401 is passed to a first MBR reactor 410 in conjunction with an olefins feedstream 402 under alkylation conditions. The effluent 403 is separated in fractionator 420 to provide a $C_7+$ bottom stream 404 and an overhead $C_7-$ stream 405. The overhead stream is passed to a second stage MBR reactor 430 in conjunction with olefin feedstream 406. The effluent 407 from the second stage alkylation reactor is separated in fractionator 440 to provide a $C_5+$ bottom stream and a $C_4-$ overhead stream 409.

What is claimed is:

1. A process for enhancing the alkylation conversion rate for a benzene-rich gasoline boiling range hydrocarbon feedstream alkylated with $C_2$–$C_5$ olefins to produce product gasoline having a reduced benzene content, said process comprising:

contacting said benzene-rich stream and said olefins with solid, shape selective aluminosilicate catalyst particles in a catalyst bed under benzene alkylation conditions wherein said benzene is sequentially contacted with said olefins in decreasing order of olefin oligomerization reactivity comprising a first contact with $C_3$–$C_5$ olefins followed by contact with $C_2$ olefin, whereby an effluent stream is produced comprising said gasoline having a reduced benzene content representing an enhanced conversion rate for said benzene.

2. The process of claim 1 wherein said catalyst comprises acidic ZSM-5.

3. The process of claim 1 wherein said benzene alkylation conditions comprise temperature between 500° F. and 1000° F., pressure between about 50 (350kPa) and 3000 psig (21000 kPa), and weight hourly space velocity between 0.1 and about 250.

4. The process of claim 1 wherein said catalyst bed comprises a fluid bed.

5. The process of claim 3 wherein said benzene alkylation conditions comprise temperature 700°–850° F., pressure between 50–200 psig, and weight hourly space velocity between about 1 and 100.

6. The process of claim 1 wherein said olefins are selected from the group consisting of ethylene, propylene, 1-butene, 2-butene, isobutene and isomers of amylene.

7. The process of claim 1 wherein said product gasoline also has a lower Reid vapor pressure.

8. The process of claim 1 wherein said product gasoline has a lower sulfur content relative to said gasoline feedstream.

9. The process of claim 1 wherein said benzene content is lowered by at least 40 weight percent relative to said hydrocarbon feedstream.

10. In the process for reducing the benzene content of reformate comprising alkylating a reformate feedstream with $C_2$–$C_5$ light olefins in a fluid bed reactor in contact with shape selective metallosilicate catalyst particles, the improvement comprising:

contacting said reformate feedstream sequentially with said light olefins in decreasing order of olefin oligomerization reactivity comprising a first contact with $C_3$–$C_5$ olefins followed by contact with $C_2$ olefin, whereby an effluent stream is produced comprising gasoline having a reduced benzene content representing an enhanced conversion rate for said benzene.

11. The process of claim 10 wherein said catalyst comprises acidic ZSM-5.

12. The process of claim 10 wherein said benzene alkylation conditions comprise temperature between 500° F. and 1000° F., pressure between about 50 (350 Kpa) and 3000 psig (21000 Kpa), and weight hourly space velocity between 0.1 and about 250.

13. A multi-stage process for enhancing the alkylation conversion rate for a benzene-rich gasoline boiling range hydrocarbon feedstream alkylated with a hydrocarbon stream comprising $C_2$–$C_5$ olefins to produce product gasoline having a reduced benzene content, said multi-stage process comprising:

contacting said benzene-rich feed stream in a first stage fluid bed alkylation zone with shape selective metallosilicate catalyst particles and the $C_3$–$C_5$ portion of said olefins under benzene alkylation conditions;

distilling the effluent from said first stage alkylation zone to produce an overhead stream comprising $C_6$– hydrocarbons containing unreacted benzene and a bottom stream comprising $C_7$+ hydrocarbons containing alkylated benzene;

contacting said overhead stream with the $C_2$ portion of said olefins in a second stage fluid bed alkylation zone with shape selective metallosilicate catalyst particles under benzene alkylation conditions whereby a second stage effluent stream is produced comprising alkylated benzene and unreacted $C_6$– hydrocarbons; and separating said second stage effluent stream.

14. The process of claim 13 wherein said catalyst comprises acidic ZSM-5.

15. The process of claim 13 wherein said benzene alkylation conditions comprise temperature between 500° F. and 1000° F., pressure between about 50 (350 kPa) and 3000 psig (21000 kPa), and weight hourly space velocity between 0.1 and about 250.

16. The process of claim 13 wherein the alkylation conversion rate for benzene is at least 40%.

17. The process of claim 13 wherein said first zone comprises a dilute riser reactor and the effluent from said first zone is passed directly to said second zone.

18. A fluid bed process for enhancing the alkylation conversion rate for a benzene-rich gasoline boiling range hydrocarbon feedstream alkylated with a hydrocarbon stream comprising $C_2$–$C_5$ olefins to produce product gasoline having a reduced benzene content, said process comprising:

passing the portion of said olefins comprising $C_3$–$C_5$ olefins under benzene alkylation conditions to a bottom portion of said bed comprising shape selective metallosilicate catalyst particles;

passing the portion of said olefins comprising $C_2$ olefin to a mid-portion of said bed;

removing deactivated catalyst from a top portion of said bed and regenerating said catalyst;

passing regenerated catalyst to a bottom portion of said bed.

recovering from said bed an effluent comprising said gasoline product.

19. The process of claim 18 wherein said catalyst comprises acidic ZSM-5.

20. The process of claim 18 wherein said product gasoline also has a lower Reid vapor pressure.

21. The process of claim 18 wherein said product gasoline has a lower sulfur content relative to said gasoline feedstream.

22. A fluid bed process for enhancing the alkylation conversion rate for a benzene-rich gasoline boiling range hydrocarbon feedstream alkylated with hydrocarbon feedstreams comprising $C_2$–$C_5$ olefins to produce product gasoline having a reduced benzene content, said process comprising:

passing the portion of said olefins comprising $C_3$–$C_5$ olefins and said benzene feedstream under benzene alkylation conditions to a first riser reactor containing shape selective metallosilicate catalyst particles;

passing the portion of said olefins comprising $C_2$ olefin to a bottom portion of a second fluid bed containing metallosilicate catalyst particles under alkylation conditions mid-portion of said bed;

passing the effluent from said riser reactor to a mid-portion of said second fluid bed, removing deactivated catalyst from a top portion of said second bed and regenerating said catalyst;

passing regenerated catalyst to said riser reactor;

recovering from said second bed an effluent comprising said gasoline product.

* * * * *